US005520449A

United States Patent [19]

Klak

[11] Patent Number: 5,520,449

[45] Date of Patent: May 28, 1996

[54] ASBESTOS GLOVE BAG

[76] Inventor: Joseph V. Klak, 509 Central Ave., Pittsburgh, Pa. 15238

[21] Appl. No.: 409,417

[22] Filed: Mar. 24, 1995

[51] Int. Cl.[6] ..... A61G 11/00; B65D 33/14; B65D 33/20

[52] U.S. Cl. ..... 312/1; 383/7; 383/24; 383/61; 383/84

[58] Field of Search ..... 312/1; 55/385.2; 454/57; 600/21; 383/7, 11, 15, 24, 29–31, 84, 86, 95, 98, 61

[56] References Cited

U.S. PATENT DOCUMENTS

| | | | |
|---|---|---|---|
| 4,421,150 | 12/1983 | Masters | 383/61 |
| 4,626,291 | 12/1986 | Natak | 600/21 X |
| 4,759,643 | 7/1988 | Canno | 383/84 |
| 4,783,129 | 11/1988 | Jacobson | 312/1 |
| 4,883,329 | 11/1989 | Flannery et al. | 312/1 |
| 4,901,743 | 2/1990 | Hittler | 312/1 X |
| 4,912,358 | 3/1990 | Vitta | 312/1 |
| 5,017,197 | 5/1991 | McGuire et al. | 55/385.2 X |
| 5,131,934 | 7/1992 | Patel | 55/385.1 |
| 5,147,242 | 9/1992 | Lowe, Jr. | 312/1 X |

FOREIGN PATENT DOCUMENTS

| | | | |
|---|---|---|---|
| 1188191 | 6/1985 | Canada | 312/1 |
| 1567270 | 5/1980 | United Kingdom | 312/1 |
| WO89/08511 | 9/1989 | WIPO | 312/1 |

*Primary Examiner*—Bryon P. Gehman

[57] ABSTRACT

An asbestos glove bag comprised of a glove bag having a zip-loc closure within an interior surface of the glove bag. A pair of arm and glove sleeves are secured to the interior surface of the glove bag. A flap portion is secured to the glove bag adjacent to an open top thereof. The flap portion has tab portions extending outwardly therefrom. The flap portion and tab portions have a pressure sensitive adhesive strip thereon. The pressure sensitive adhesive strip has a peel off film removably coupled therewith. The flap portion secures over the open top of the glove bag with the pressure sensitive adhesive engaging the front wall of the glove bag and the tab portions engaging the rear wall of the glove bag.

6 Claims, 3 Drawing Sheets

ASBESTOS GLOVE BAG

BACKGROUND OF THE INVENTION

1. Field of the Invention

The present invention relates to an asbestos glove bag and more particularly pertains to aiding a user in the containing and the removal of asbestos with an asbestos glove bag.

2. Description of the Prior Art

The use of glove bags is known in the prior art. More specifically, glove bags heretofore devised and utilized for the purpose of containing hazardous materials are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,147,242 to Lowe,Jr. discloses a negative air bag.

U.S. Pat. No. 5,131,934 to Patel discloses an apparatus for removing hazardous particulate and fibrous materials.

U.S. Pat. No. 5,017,197 to McGuire et al. discloses a glove bag and method of use.

U.S. Pat. No. 4,901,743 to Hittler discloses a safety glove bag.

U.S. Pat. No. 4,783,129 to Jacobson discloses a hazardous waste glove removal system.

While these devices fulfill their respective, particular objective and requirements, the aforementioned patents do not describe an asbestos glove bag for aiding a user in the containing and the removal of asbestos.

In this respect, the asbestos glove bag according to the present invention substantially departs from the conventional concepts and designs of the prior art, and in doing so provides an apparatus primarily developed for the purpose of aiding a user in the containing and the removal of asbestos.

Therefore, it can be appreciated that there exists a continuing need for new and improved asbestos glove bag which can be used for aiding a user in the containing and the removal of asbestos. In this regard, the present invention substantially fulfills this need.

SUMMARY OF THE INVENTION

In the view of the foregoing disadvantages inherent in the known types of glove bags now present in the prior art, the present invention provides an improved asbestos glove bag. As such, the general purpose of the present invention, which will be described subsequently in greater detail, is to provide a new and improved asbestos glove bag and method which has all the advantages of the prior art and none of the disadvantages.

To attain this, the present invention essentially comprises a glove bag having an open top, a closed bottom, a front wall, a rear wall, an interior surface, and an exterior surface. The open top has a zip-loc closure within the interior surface of the glove bag. The device contains a pair of arm and glove sleeves. Each of the arm and glove sleeves has an open top portion and a closed bottom portion. The closed bottom portion is adapted for a user's hands. Each open top portion is secured to the interior surface of the glove bag to the rear wall thereof. The device contains a tool pouch having an open top and a closed bottom. The tool pouch is secured to the interior surface of the glove bag to the rear wall thereof.

A flap portion is secured to the rear wall of the glove bag adjacent to the open top thereof. The flap portion has tab portions extending outwardly therefrom. The flap portion and tab portions have a pressure sensitive adhesive strip thereon. The pressure sensitive adhesive strip has a peel off film removably coupled therewith. The flap portion secures over the open top of the glove bag with the pressure sensitive adhesive engaging the front wall of the glove bag and the tab portions engaging the rear wall of the glove bag.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved asbestos glove bag which has all the advantages of the prior art glove bags and none of the disadvantages.

It is another object of the present invention to provide a new and improved asbestos glove bag which may be easily and efficiently manufactured and marketed.

It is a further object of the present invention to provide a new and improved asbestos glove bag which is of durable and reliable construction.

An even further object of the present invention is to provide a new and improved asbestos glove bag which is susceptible of a low cost of manufacture with regard to both materials and labor, and which accordingly is then susceptible of low prices of sale to the consuming public, thereby making such an asbestos glove bag economically available to the buying public.

Still yet another object of the present invention is to provide a new and improved asbestos glove bag which provides in the apparatuses and methods of the prior art some of the advantages thereof, while simultaneously overcoming some of the disadvantages normally associated therewith.

Even still another object of the present invention is to provide a new and improved asbestos glove bag for aiding a user in the containing and the removal of asbestos.

Lastly, it is an object of the present invention to provide a new and improved asbestos glove bag comprised of a glove bag having a zip-loc closure within an interior surface of the glove bag. A pair of arm and glove sleeves are secured to the interior surface of the glove bag. A flap portion is secured to the glove bag adjacent to an open top thereof. The flap portion has tab portions extending outwardly therefrom. The flap portion and tab portions have a pressure sensitive adhesive strip thereon. The pressure sensitive adhesive strip has a peel off film removably coupled therewith. The flap portion secures over the open top of the glove bag with the pressure sensitive adhesive engaging the front wall of the glove bag and the tab portions engaging the rear wall of the glove bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
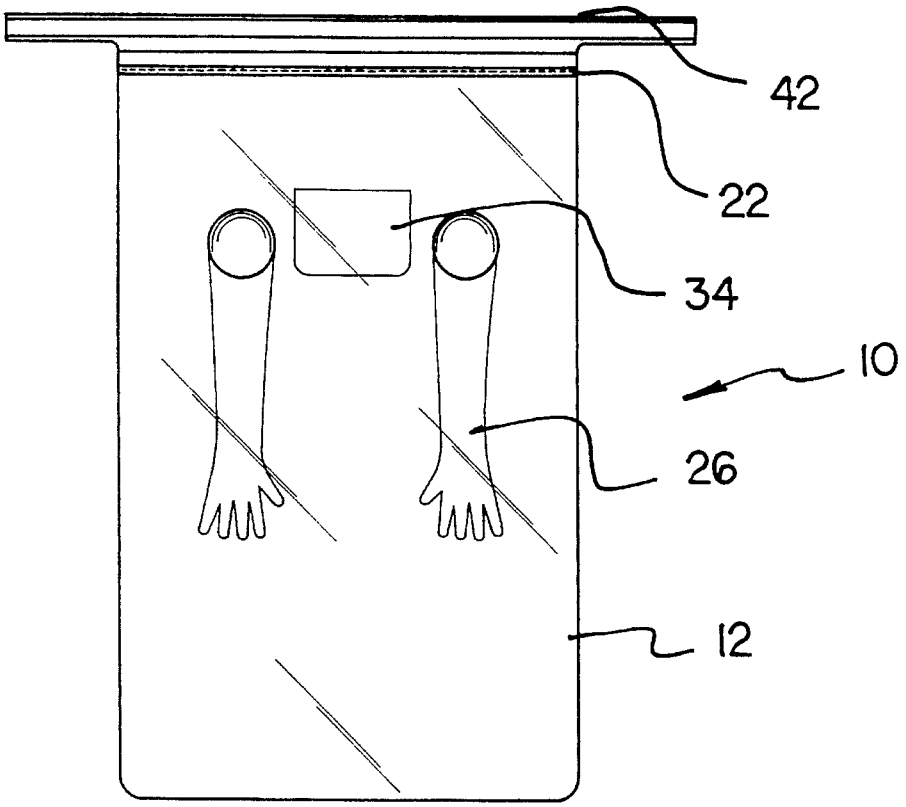
FIG. 1 is a perspective view of the preferred embodiment of the asbestos glove bag constructed in accordance with the principles of the present invention.
Figure 2:
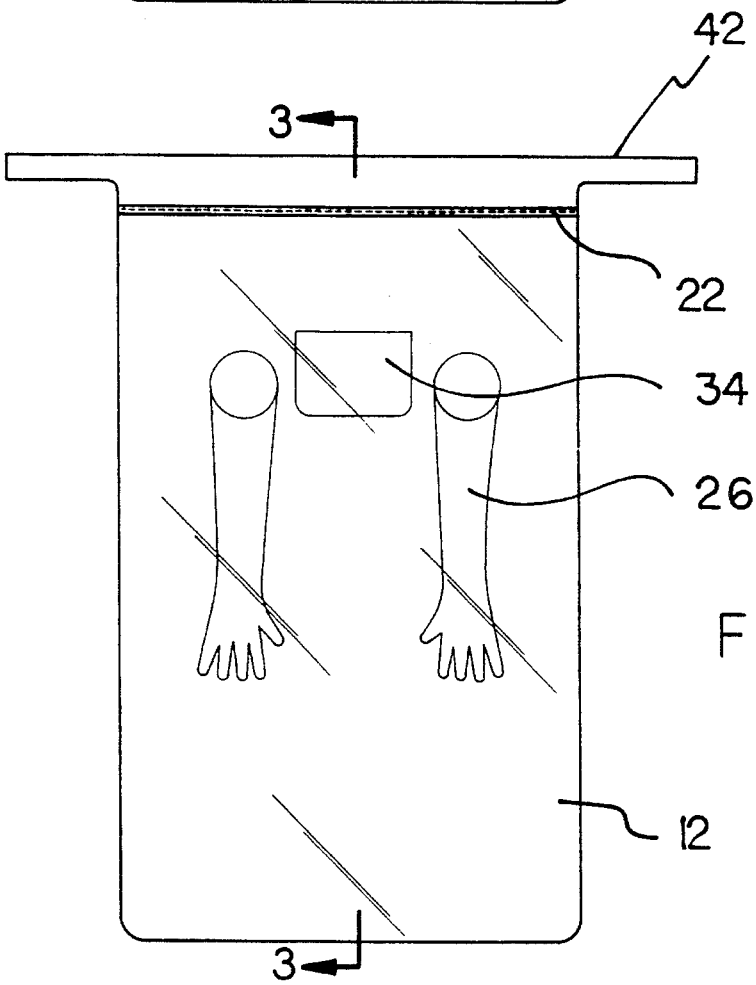
FIG. 2 is an elevated rear view of the present invention.
Figure 3:
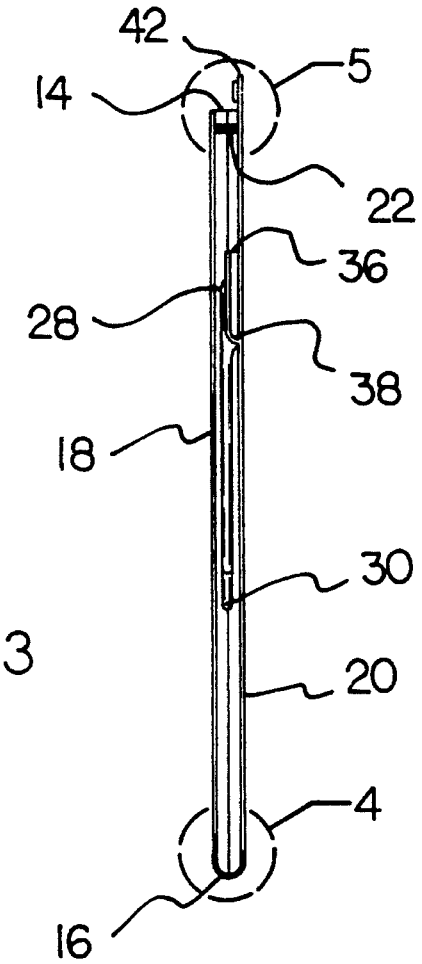
FIG. 3 is a cross-sectional view as taken along line 3—3 of FIG. 2.
Figure 4:
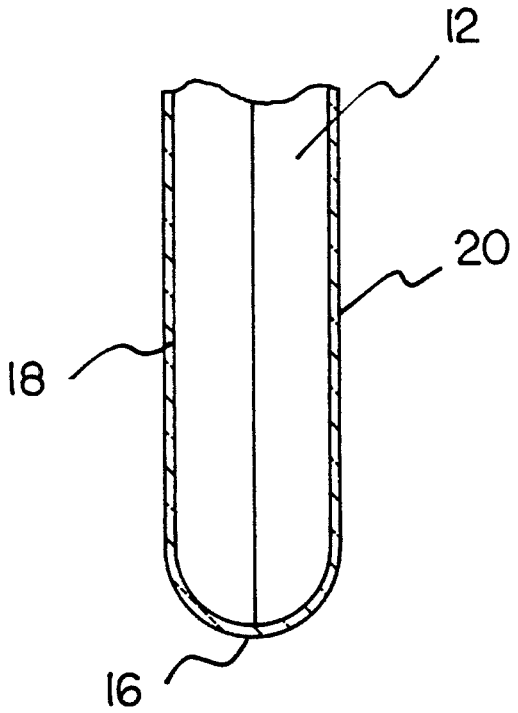
FIG. 4 is a fragmentary view of the securement of the front portion to the back portion at the lower edges thereof.
Figure 5:
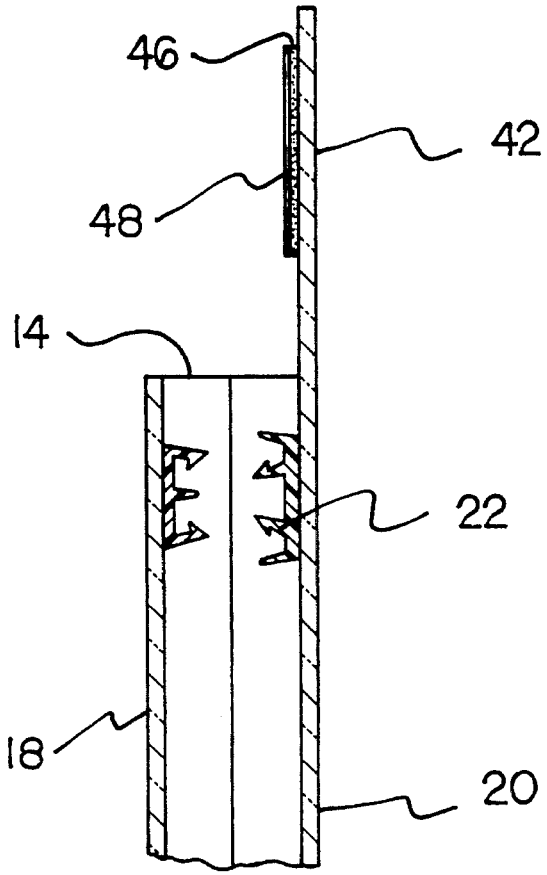
FIG. 5 is a fragmentary view of the closure means of the present invention.
Figure 6:
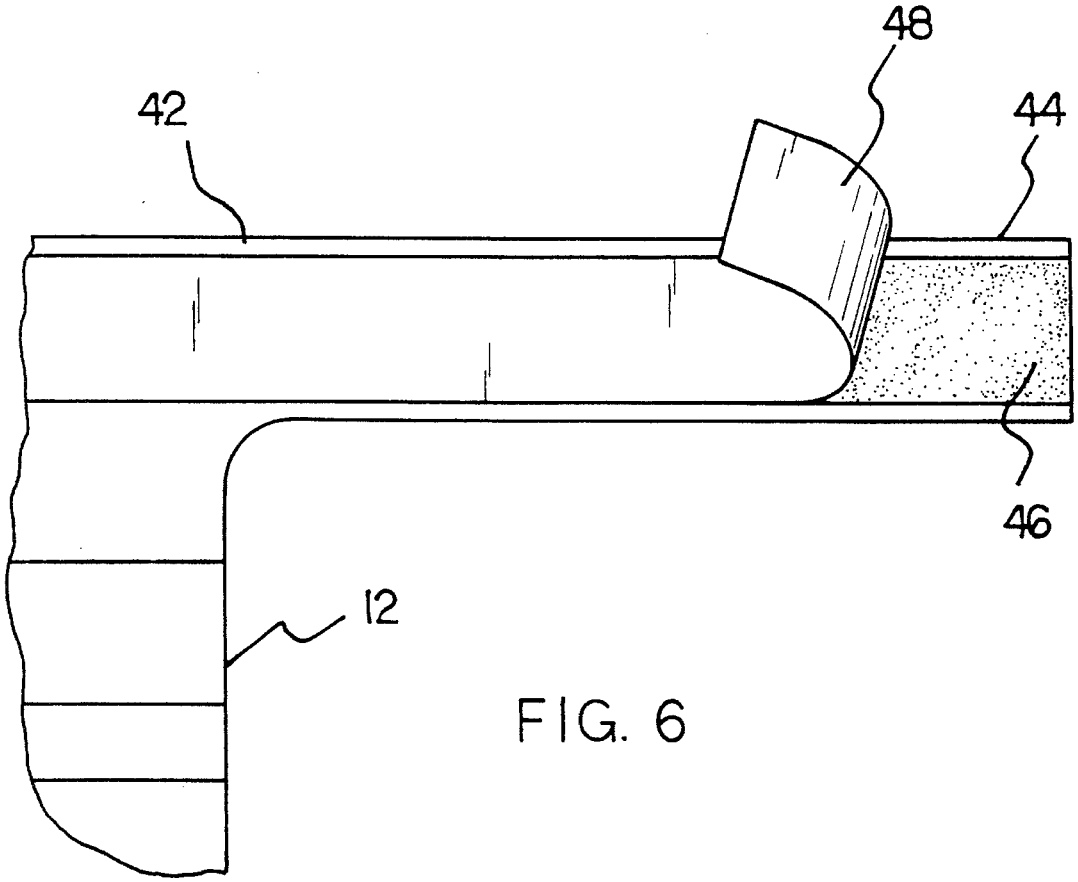
FIG. 6 is a front view of the end flaps of the present invention.

With reference now to the drawings, and in particular, to FIGS. 1–6 thereof, the preferred embodiment of the new and improved asbestos glove bag embodying the principles and concepts of the present invention and generally designated by the reference number 10 will be described.

Specifically, it will be noted in the various Figures that the device relates to a new and improved asbestos glove bag for aiding a user in the containing and the removal of asbestos. In its broadest context, the device consists of a glove bag, a pair of arm and glove sleeves, a tool pouch, and a flap portion.

The device 10 contains a glove bag 12 having an open top 14, a closed bottom 16, a front wall 18, a rear wall 20, an interior surface, and an exterior surface. The open top 14 has a zip-loc closure 22 within the interior surface of the glove bag 12. The zip-loc closure 22 extends the entire width of the glove bag 12. The zip-loc closure 22 is used to close the glove bag 12 after asbestos has been removed. The glove bag 12 is preferably fabricated of six millimeter plastic and measures approximately five feet in length by three feet in width. The device 10 is a modified version of plastic glove bags commonly used in the asbestos removal industry.

The device 10 contains a pair of arm and glove sleeves 26. Each of the arm and glove sleeves 26 has an open top portion 28 and a closed bottom portion 30. The closed bottom portion 30 is adapted for a user's hands. Each open top portion 28 is secured to the interior surface of the glove bag 12 to the rear wall 20 thereof. The pair of arm and glove sleeves 26 are used by workers for insertion of their arms therein during the asbestos removal process.

The device 10 contains a tool pouch 34 having an open top 36 and a closed bottom 38. The tool pouch 34 is secured to the interior surface of the glove bag 12 to the rear wall 20 thereof. The tool pouch 34 provides a place for the worker's to hold their tools during the removal process. The tool pouch 34 is preferably positioned between the pair of arm and glove sleeves 26.

A flap portion 42 is secured to the rear wall 20 of the glove bag 12 adjacent to the open top 14 thereof. The flap portion 42 has tab portions 44 extending outwardly therefrom. The flap portion 42 and tab portions 44 have a pressure sensitive adhesive strip 46 thereon. The pressure sensitive adhesive strip 46 has a peel off film 48 removably coupled therewith. The flap portion 42 secures over the open top 14 of the glove bag 12 with the pressure sensitive adhesive strip 46 engaging the front wall 18 of the glove bag 12 and the tab portions 44 engaging the rear wall 20 of the glove bag 12. After the zip-loc closure 22 is engaged to close the open top 14 of the glove bag 12, the flap portion 42 is then folded over, with the pressure sensitive adhesive strip 46 on the flap portion 42 sealing over the closed open top 14 of the glove bag 12. The tab portions 44 are then folded backwards to provide a double-sealed bag which is more likely to remain securely closed. The ease of the application of this device 10 eliminates the need for an additional worker to perform efficient asbestos removal.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An asbestos glove bag for aiding a user in the containing and the removal of asbestos comprising, in combination:

a glove bag having an open top, a closed bottom, a front wall, a rear wall, an interior surface, and an exterior surface, the open top having a zip-loc closure within the interior surface of the glove bag;

a pair of arm and glove sleeves, each of the arm and glove sleeves having an open top portion and a closed bottom portion, the closed bottom portion adapted for a user's hands, each open top portion secured to the interior surface of the glove bag to the rear wall thereof;

a tool pouch having an open top and a closed bottom, the tool pouch secured to the interior surface of the glove bag to the rear wall thereof;

a flap portion secured to the rear wall of the glove bag adjacent to the open top thereof, the flap portion having tab portions extending outwardly therefrom, the flap portion and tab portions having a pressure sensitive adhesive strip thereon, the pressure sensitive adhesive strip having a peel off film removably coupled therewith, the flap portion securing over the open top of the glove bag with the pressure sensitive adhesive engaging the front wall of the glove bag and the tab portions engaging the rear wall of the glove bag.

2. An asbestos glove bag for aiding a user in the containing and the removal of asbestos comprising, in combination:

a glove bag having a zip-loc closure within an interior surface of the glove bag;

a pair of arm and glove sleeves secured to the interior surface of the glove bag;

a flap portion secured to the glove bag adjacent to an open top thereof, the flap portion having tab portions extending outwardly therefrom, the flap portion and tab portions having a pressure sensitive adhesive strip thereon, the pressure sensitive adhesive strip having a peel off film removably coupled therewith, the flap portion securing over the open top of the glove bag with the pressure sensitive adhesive engaging the front wall of the glove bag and the tab portions engaging the rear wall of the glove bag.

3. The glove bag as described in claim 2 and further including wherein the glove bag having an open top, a closed bottom, a front wall, a rear wall, an interior surface, and an exterior surface, the open top having a zip-loc closure within the interior surface of the glove bag.

4. The glove bag as described in claim 3 and further including wherein each of the arm and glove sleeves having an open top portion and a closed bottom portion, the closed bottom portion adapted for a user's hands, each open top portion secured to the interior surface of the glove bag to the rear wall thereof.

5. The glove bag as described in claim 4 and further including a tool pouch having an open top and a closed bottom, the tool pouch secured to the interior surface of the glove bag to the rear wall thereof.

6. The glove bag as described in claim 1 and further including wherein the glove bag is fabricated of six millimeter plastic.

* * * * *